US009818297B2

(12) United States Patent
El-Tantawy et al.

(10) Patent No.: US 9,818,297 B2
(45) Date of Patent: Nov. 14, 2017

(54) MULTI-AGENT REINFORCEMENT LEARNING FOR INTEGRATED AND NETWORKED ADAPTIVE TRAFFIC SIGNAL CONTROL

(71) Applicant: Pragmatek Transport Innovations, Inc., Mississauga (CA)

(72) Inventors: Samah El-Tantawy, Toronto (CA); Baher Abdulhai, Toronto (CA)

(73) Assignee: PRAGMATEK TRANSPORT INNOVATIONS, INC., Mississauga, Ontario ( * ) Notice: Subject to any disclaimer, the term of this patent is extended or adjusted under 35 U.S.C. 154(b) by 0 days.

(21) Appl. No.: 14/364,998

(22) PCT Filed: Dec. 10, 2012

(86) PCT No.: PCT/CA2012/050887

§ 371 (c)(1),
(2) Date: Jun. 12, 2014

(87) PCT Pub. No.: WO2013/086629

PCT Pub. Date: Jun. 20, 2013

(65) Prior Publication Data

US 2015/0102945 A1 Apr. 16, 2015

Related U.S. Application Data

(60) Provisional application No. 61/576,637, filed on Dec. 16, 2011.

(51) Int. Cl.
*G08G 1/081* (2006.01)
*G08G 1/083* (2006.01)

(52) U.S. Cl.
CPC ..... *G08G 1/081* (2013.01); *G08G 1/083* (2013.01)

(58) Field of Classification Search
None
See application file for complete search history.

(56) References Cited

U.S. PATENT DOCUMENTS 3,662,329 A 5/1972 Hill
3,818,429 A 6/1974 Meyer
(Continued)

FOREIGN PATENT DOCUMENTS

CA 2774127 A1 3/2011

OTHER PUBLICATIONS

Bazzan, Ana LC. "A distributed approach for coordination of traffic signal agents." Autonomous Agents and Multi-Agent Systems 10.1 (2005):131-164. < http://link.springer.com/article/10.1007/s10458-004-6975-9>. Retrieved Sep. 1, 2015.*
(Continued)

*Primary Examiner* — Laura Nguyen
(74) *Attorney, Agent, or Firm* — Bhole IP Law; Anil Bhole

(57) ABSTRACT

A system and method of multi-agent reinforcement learning for integrated and networked adaptive traffic controllers (MARLIN-ATC). Agents linked to traffic signals generate control actions for an optimal control policy based on traffic conditions at the intersection and one or more other intersections. The agent provides a control action considering the control policy for the intersection and one or more neighboring intersections. Due to the cascading effect of the system, each agent implicitly considers the whole traffic environment, which results in an overall optimized control policy.

18 Claims, 7 Drawing Sheets

(56) References Cited

U.S. PATENT DOCUMENTS

| | | | | |
|---|---|---|---|---|
| 4,323,970 | A | 4/1982 | Brunner | |
| 5,357,436 | A | 10/1994 | Chiu | |
| 5,668,717 | A * | 9/1997 | Spall | G08G 1/081 700/51 |
| 6,339,383 | B1 | 1/2002 | Kobayashi | |
| 6,617,981 | B2 | 9/2003 | Basinger | |
| 6,937,161 | B2 | 8/2005 | Nishimura | |
| 6,985,090 | B2 | 1/2006 | Ebner | |
| 7,098,805 | B2 | 8/2006 | Meadows | |
| 7,893,846 | B2 | 2/2011 | Teffer | |
| 8,040,254 | B2 | 10/2011 | Delia | |
| 2007/0273552 | A1 | 11/2007 | Tischer | |
| 2008/0204277 | A1 | 8/2008 | Sumner | |
| 2011/0181440 | A1 | 7/2011 | Bunz | |
| 2013/0013178 | A1* | 1/2013 | Brant | G08G 1/0116 701/117 |
| 2013/0099942 | A1* | 4/2013 | Mantalvanos | G08G 1/082 340/910 |

OTHER PUBLICATIONS

Bazzan, Ana LC. "A distributed approach for coordination of traffic signal agents." Autonomous Agents and Multi-Agent Systems 10.1 (2005): 131-164. < http://link.springer.com/article/10.1007/s10458-004-6975-9>. Retrieved Sep. 1, 2015.*

Abdoos, Monireh, Nasser Mozayani, and Ana LC Bazzan. "Traffic light control in non-stationary environments based on multi agent Q-learning." Intelligent Transportation Systems (ITSC), 2011 14th International IEEE Conference on. IEEE, 2011.*

Abdulhai, B., R. Pringle and G. J. Karakoulas (2003). Reinforcement learning for true adaptive traffic signal control. Journal of Transportation Engineering 129(3): 278-285.

El-Tantawy, S., and B. Abdulhai (2010). An Agent-Based Learning towards Decentralized and Coordinated Traffic Signal Control. In proceedings of the 13th International IEEE Annual Conference on Intelligent Transportation Systems (ITSC), Madeira, Portugal.

El-Tantawy, S., and B. Abdulhai (2010). Temporal Difference Learning-Based Adaptive Traffic Signal Control. In proceedings of the12th World Conference on Transport Research (WCTR), Lisbon, Portugal.

El-Tantawy, S. and B. Abdulhai (2010). Towards multi-agent reinforcement learning for integrated network of optimal traffic controllers (MARLIN-OTC). Transportation Letters: The International Journal of Transportation Research 2(2): 89-110.

El-Tantawy, S. and B. Abdulhai (2011). Comprehensive Analysis of Reinforcement Learning Methods and Parameters for Adaptive Traffic Signal Control. In proceedings of Transportation Research Board Conference, Washington D.C.

Ono, N. and K. Fukumoto (1996). Multi-agent reinforcement learning: A modular approach. Second International Conference on Multi-Agent Systems.

Yagan, D. and C. Tham (2007). Coordinated reinforcement learning for decentralized optimal control. IEEE International Symposium on Approximate Dynamic Programming and Reinforcement Learning.

Gosavi, A. (2003). Simulation-Based Optimization: Parametric Optimization Techniques and Reinforcement Learning. Springer, Netherlands.

Weinberg, M. and J. S. Rosenschein (2004). Best-response multiagent learning in non-stationary environments. 3rd International Joint Conference on Autonomous Agents and Multiagent Systems.

Nair, R., P. Varakantham, M. Tambe and M. Yokoo (2005). Networked distributed POMDPs: A synthesis of distributed constraint optimization and POMDPs. 20th National Conference on Artificial Intelligence.

Sutton, R. S. and A. G. Barto (1998). Reinforcement Learning: An Introduction. MIT Press Cambridge, MA.

Lu, S., Liu, X., & Dai, S. 2008. Incremental multistep Q-learning for adaptive traffic signal control based on delay minimization strategy. Presented at the 7th World Congress on Intelligent Control and Automation, Jun. 25-27, Chungking, China.

A. Salkham, R. Cunningham, A. Garg, and V. Cahill, "A collaborative reinforcement learning approach to urban traffic control optimization," in Proc. IEEE/WIV/ACM Int. Conf. Web Intell. Intell. Agent Technol., 2008,pp. 560-566.

L. Busoniu, R. Babuska, and B. De Schutter, "A comprehensive survey of multiagent reinforcement learning," IEEE Trans. Syst., Man, Cybern. C, Appl. Rev., vol. 38, No. 2, pp. 156-172, Mar. 2008.

A. L. C. Bazzan, "A distributed approach for coordination of traffic signal agents," Autonom. Agents Multi-Agent Syst., vol. 10, No. 1, pp. 131-164, Jan. 2005.

Y. S. Murat and E. Gedizlioglu, "A fuzzy logic multi-phased signal control model for isolated junctions," Transportation Research Part C: Emerging Technologies, vol. 13, pp. 19-36,2005.

C. Diakaki, M. Papageorgiou, and K. Aboudolas, "A multivariable regulator approach to traffic responsive network-wide signal control," Control Eng. Pract., vol. 10, No. 2, pp. 183-195, Feb. 2002.

Chen, B., & Cheng, H. H. 2010. A review of the applications of agent technology in traffic and transportation systems. IEEE Transactions on Intelligent Transportation Systems, 11,485-497.

M.B. Trabia, M. S. Kaseko, and M. Ande, "A two-stage fuzzy logic controller for traffic signals," Transportation Research Part C: Emerging Technologies, vol. 7, pp. 353-367, 1999.

25. T. Li, D. B. Zhao, and J. Q. Yi, "Adaptive dynamic programming for multi-intersections traffic signal intelligent control," in Proc. 11th Int. IEEE Conf. Intell. Transp. Syst., 2008, pp. 286-291.

J.C. Pacheco and R. J. F. Rossetti "Agent-Based Traffic Control: a Fuzzy Q-Learning Approach," presented at The 13th International IEEE Conference on Intelligent Transportation Systems pp. 1172-1177, 2010.

Jacob, C. 2005. Optimal, integrated and adaptive traffic corridor control: A machine learning approach. Department of Civil Engineering, University of Toronto, Toronto, Canada.

B. Park and M. Qi. Development and Evaluation of a Procedure for the Calibration of Simulation Models. http://faculty.virginia.edu/brianpark/SimCalVal/Docs/trb05-simcalval.pdf.

E. Camponogara and W. Kraus, Jr., "Distributed learning agents in ur-ban traffic control," in Proc. 11th Portuguese Conf. Artif. Intell., 2003, pp. 324-335.

Leng, J., Fyfe, C.,&Jain, L. C. 2009. Experimental analysis on SARSA ( ) and Q ( ) with different eligibility traces strategies. Journal of Intelligent and Fuzzy Systems, 20, 73-82.

K. L. Head, P. B. Mirchandani, and D. Sheppard, "Hierarchical framework for real-time traffic control," Transp. Res. Rec., vol. 1360, pp. 82-88, 1992.

Z. Yang, X. Huang, C. Du, M. Tang, and F. Yang, "Hierarchical fuzzy logic traffic controller for urban signalized intersections," presented at The 7th World Congress on Intelligent Control and Automation, Chongqing, China pp. 5203-5207, 2008.

T. Thorpe, "Vehicle traffic light control using sarsa," M.S. thesis, Comput. Sci. Dept., Colo. St. Univ., Fort Collins, CO, USA, 1997.

Wahba, M. 2008. MILATRAS: MIcrosimulation Learning-based Approach to TRansit ASsignment. Department of Civil Engineering, University of Toronto, Toronto, Canada.

M. Wiering, "Multi-agent reinforcement learning for traffic light control," in Proc. 17th Int. Conf. Mach. Learn., 2000, pp. 1151-1158.

L. Kuyer, S. Whiteson, B. Bakker, and N. Vlassis, "Multiagent reinforcement learning for urban traffic control using coordination graph," in Proc. 19th Eur. Conf. Mach. Learn., 2008, pp. 656-671.

S. Richter, D. Aberdeen, and J. Yu, "Natural actor-critic for road traffic optimisation," in Advances in Neural Information Processing Systems. Cambridge, MA, USA: MIT Press, 2007.

Jang, J. S. R., Sun, C. T., & Mizutani, E. 1997. Neuro-fuzzy and soft computing. Upper Saddle River, NJ: Prentice Hall.

N. H. Gartner, "Development of demand-responsive strategies for urban traffic control" System Modelling and Optimization. Lecture Notes in Control and Information Sciences. vol. 59, pp. 166-174, 2005.

(56) References Cited

OTHER PUBLICATIONS

A. L. C. Bazzan, "Opportunities for multiagent systems and multiagent reinforcement learning in traffic control," Autonomous Agents Multi-Agent Syst., vol. 18, No. 3, pp. 342-375, Jun. 2009.
L. Shoufeng, L. Ximin, and D. Shiqiang, "Q-Learning for adaptive traffic signal control based on delay minimization strategy," in Proc. IEEE Int.Conf. Netw. Sens. Control, 2008, pp. 687-691.
C. Watkins and P. Dayan, "Q-learning," Mach. Learn., vol. 8, pp. 279-292, 1992.
Kaelbling, L. P., Littman,M. L., &Moore, A.W. 1996. Reinforcement learning: A survey. Journal of Artificial Intelligence, 4, 237-285.
Bingham, E. 2001. Reinforcement learning in neurofuzzy traffic signal control. European Journal of Operational Research, 131, 232-241.
B. Abdulhai and L. Kaftan, "Reinforcement learning: Introduction to theory and potential for transport applications," Can. J. Civil Eng., vol. 30, No. 6, pp. 981-991, Dec. 2003.
de Queiroz, M. S., de Berrdo, R. C., & de P'adua Braga, A. 2006. Reinforcement learning of a simple control task using the spike response model. Neurocomputing, 70, 14-20.
D. De Oliveira, A. L. C. Bazzan, B. C. da Silva, E. W. Basso, L. Nunes, R. Rossetti, E. de Oliveira, R. da Silva, and L. Lamb, "Reinforcement learning-based control of traffic lights in non-stationary environments: A case study in a microscopic simulator," in Proc. EUMAS, 2006, pp. 31-42.
I. Arel, C. Liu, T. Urbanik, and A. G. Kohls, "Reinforcement learning-based multi-agent system for network traffic signal control," IET Intell. Transp. Syst., vol. 4, No. 2, pp. 128-135, Jun. 2010.
A. G. Sims and K. W. Dobinson, "SCAT—The Sydney co-ordinated adaptive traffic system: Philosophy and benefits," presented at the Int. Symp. Traffic Control Systems, Berkeley, CA, USA, 1979.
J. Niittymaki and M. Pursula, "Signal control using fuzzy logic," Fuzzy Sets and Systems, vol. 116, pp. 11-22, 2000.
J. Li and H. Zhang, "Study on optimal control and simulation for urban traffic based on fuzzy logic," presented at Proceedings of the International Conference on Intelligent Computation Technology and Automation, pp. 936-940, 2008.
Metrolinx, "The Big Move: Transforming transportation in the Greater Toronto and Hamilton Area," Metrolinx, Toronto, 2008.
C. Claus and C. Boutilier, "The dynamics of reinforcement learning in co-operative multiagent systems," in Proc. 15th Nat. Conf. Artif. Intell./10th Conf. Innov. Appl. Artif. Intell., Madison, WI, USA, 1998, pp. 746-752.
J. L. Farges, J. J. Henry, and J. Tufal, "The PRODYN real-time traffic algorithm," presented at the 4th IFAC/IFIP/IFORS Symp. Control Transp. Syst., Baden-Baden, Germany, 1983.
Balaji, P. G., German, X., & Srinivasan, D. 2010. Urban traffic signal control using reinforcement learning agents. IET Intelligent Transport Systems, 4, 177-188.
Tan, M. Multi-Agent Reinforcement Learning: Independent vs. Cooperative Agents. In Proceedings of the Tenth International Conference on Machine Learning. pp. 330-337. Morgan Kaufman. 1993.
Office Action for corresponding Mexican Patent Application No. MX/a/2014/007056; Mexican Patent Office; dated Apr. 19, 2016.

* cited by examiner

MULTI-AGENT REINFORCEMENT LEARNING FOR INTEGRATED AND NETWORKED ADAPTIVE TRAFFIC SIGNAL CONTROL

CROSS REFERENCE

Priority is claimed from U.S. Provisional Patent Application No. 61/576,637 filed Dec. 16, 2011, which is incorporated herein by reference.

TECHNICAL FIELD

The following relates generally to adaptive traffic signal control and more specifically to multi-agent reinforcement learning for integrated and networked adaptive traffic signal control.

BACKGROUND

Traffic congestion is a major economic issue, costing some municipalities billions of dollars per year. Various adaptive traffic signal control techniques, as opposed to pre-timed and actuated signal control, have been proposed in an attempt to alleviate this problem.

Employing adaptive signal control strategies at a local level (isolated intersections) has been found to limit potential benefits. Therefore, optimally controlling the operation of multiple intersections simultaneously can be synergetic and beneficial. However, such integration typically adds significant complexity to the problem rendering a real time solution infeasible. Two distinct approaches to adaptive signal control include centralized control and decentralized control. Centralised control may limit the scalability and robustness of the overall system due to theoretical and practical issues.

In centralized control, all optimization computations need to be performed at a central computer that resides in a command centre, and as the number of intersections under simultaneous control increases, the dimensionality of the solution space grows exponentially, rendering finding a solution theoretically intractable and computationally infeasible, even for a handful of intersections. In addition, expanding the network could require upgrading the computing power at the control room. Moreover, the central computer ideally needs to communicate in real time, all the time, with all intersections. The required communication network and related cost is prohibitive for many municipalities and challenging for even large municipalities. In addition to communication cost, reliability is another challenge, especially in cases of communication failure between the intersections and the traffic management centre.

Decentralized control, on the other hand, is motivated by the above challenges of centralized control. Existing decentralized control methods, however, currently suffer from several problems. Either each local signal controller (at each intersection) is isolated, acting independently of all surrounding intersections, in which case it will not be responsive to traffic conditions elsewhere in the traffic network, or the local signal controller must obtain and consider traffic conditions from all the other intersections, in which case the problems of centralized control are repeated and exacerbated by lack of computational power at local intersections.

Additionally, most adaptive traffic techniques attempt to optimize an offset parameter (time between the beginning of the green phase of two consecutive traffic signals) but this is mainly effective where all signals have the same cycle (or multiples of cycles). Thus, it is difficult to maintain coordination if cycle lengths or phase splits are sought to vary. For this reason, these coordination techniques are typically employed along an arterial road, where the major demand is, and are not generically designed to cope with any type of traffic network or any traffic demand distribution.

Moreover, many adaptive traffic techniques attempt to optimize the signal timing plans based on models of the traffic environment (that provide system state-transition probabilities) which are difficult to generate because of the uncertainty associated with traffic arrivals and drivers' behaviour at signalized intersections.

Furthermore, many of the existing adaptive traffic signal control systems require highly-skilled labour which is often hard to find, train and retain for small municipalities or even large cities with ample resources. This problem is typical with advanced systems and knowledge-intensive applications. There is a need for considerable expertise to ensure the successful operation and implementation of an adaptive traffic signal control system, which continues to be a major challenge.

For the foregoing reasons, the behaviour of traffic signal networks is not optimized and signals are not coordinated in most existing practical implementations. Instead each signal is independently optimized. Therefore, the signals are, at best, locally optimal but collectively produce suboptimal solutions.

It is an object of the following to mitigate or obviate at least one of the above mentioned disadvantages.

SUMMARY

In one aspect, a system for adaptive traffic signal control is provided, the system comprising an agent associated with a traffic signal array, the agent operable to generate a control action for the traffic signal array by determining a joint control policy with one or more selected neighbouring traffic signals.

In another aspect, a method for adaptive traffic signal control is provided, the method comprising generating, by an agent comprising a processor, a control action for a traffic signal array associated with the agent by determining a joint control policy with one or more selected neighbouring traffic signals.

DESCRIPTION OF THE DRAWINGS

The features of the invention will become more apparent in the following detailed description in which reference is made to the appended drawings wherein.

DETAILED DESCRIPTION

Figure 1:
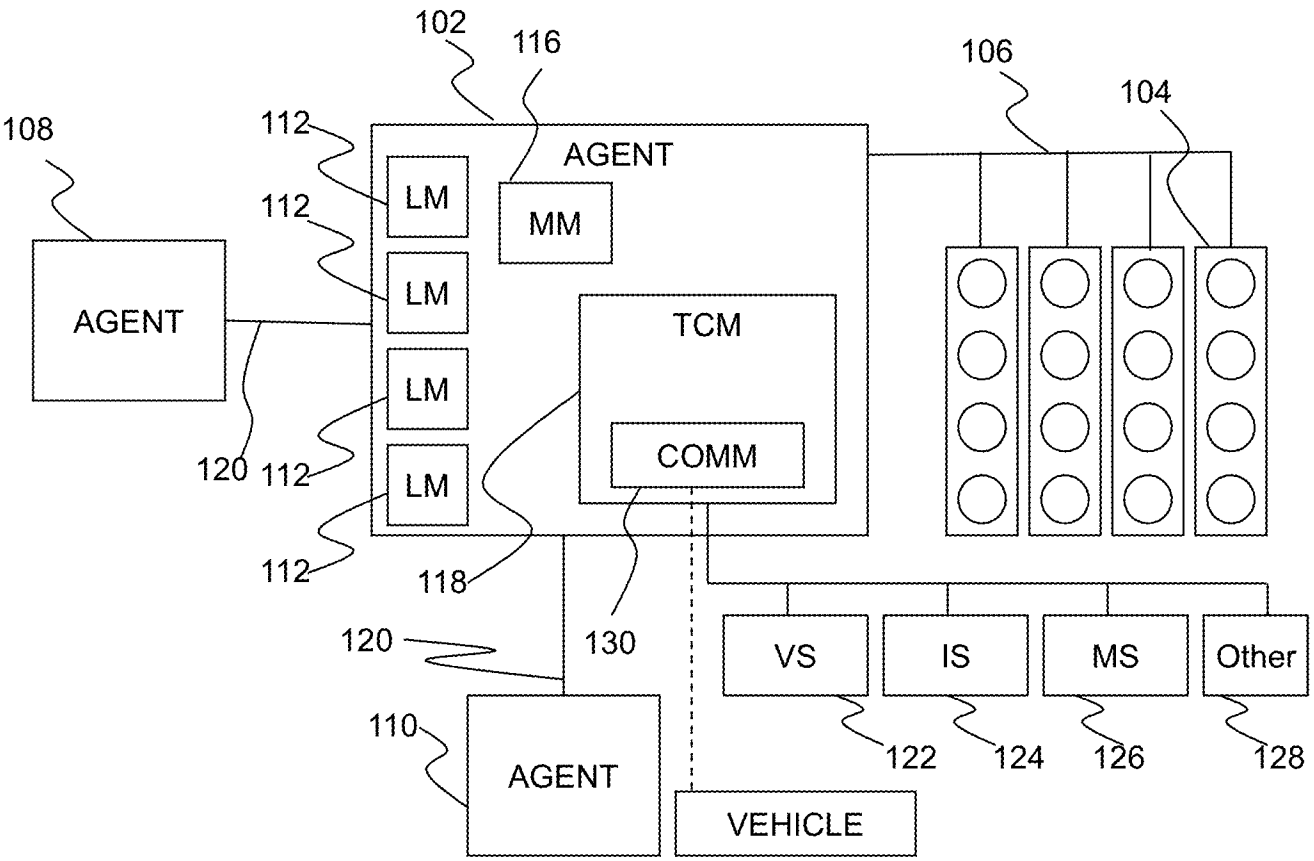
FIG. 1 illustrates an architecture diagram of an agent.

Embodiments will now be described with reference to the figures. It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It will also be appreciated that any module, unit, component, server, computer, terminal or device exemplified herein that executes instructions may include or otherwise have access to computer readable media such as storage media, computer storage media, or data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by an application, module, or both. Any such computer storage media may be part of the device or accessible or connectable thereto. Any application or module herein described may be implemented using computer readable/executable instructions that may be stored or otherwise held by such computer readable media.

A system and method for multi-agent reinforcement learning (MARL) for integrated and networked adaptive traffic signal control is provided. The system and method implement multi-agent reinforcement learning for integrated and networked adaptive traffic controllers (MARLIN-ATC) in accordance with which agents linked to traffic signals are operable to generate control actions for the traffic signals wherein the control actions follow optimal control policy based on traffic conditions at the intersection and one or more selected or predetermined neighbouring intersections.

An agent linked to a traffic signal array is operable to implement MARLIN-ATC to determine the optimal control action for the traffic signal array based on the interaction between the agent and the traffic environment without the need of having a model for the environment. That is, the optimal control action may be determined by the optimal joint policy of the various signals.

An agent linked to a traffic signal array is operable to generate a control action for the traffic signal array based on a mapping of an environment's traffic state where the environment comprises one or more intersection. The traffic signal array comprises one or more traffic signals that are coordinated (e.g., a set of traffic signals for an intersection). For example, the traffic signal array may comprise four traffic signals corresponding to northbound, southbound, eastbound and westbound traffic, these being examples which could be any combination of one or more signals in any direction(s). It will be appreciated that the traffic signal array may have greater or fewer traffic signals, and that there is no requirement for a fixed phase scheme (the order in which each group of traffic signals will be green at the same time).

The mapping from a traffic state to a control action may be referred to as a control policy. The agent may iteratively receive a feedback reward for its generated control action and adjust the control policy until it converges to an optimal control policy; that is, a control policy that provides optimal traffic flow for the environment and not merely for the agent's intersection.

Agents may be operable to implement two control modes: (1) an independent mode in which each agent operates independently of other agents by applying a multi-agent reinforcement learning for independent controllers (MARL-I); and (2) an integrated mode in which each agent is operable to coordinate its signal control actions with one or more neighbouring controllers. The former, MARL-I, implements single-agent RL methods while considering only its local state and action and is suitable for isolated intersections or where the coordination between agents is not necessary (e.g. if intersections are far apart and hence have little effect on each other). Agents may be operable to select or switch between the former and latter modes, for example in response to loss/establishment of network connectivity between other signals.

MARLIN-ATC integrated mode may comprise two coordination processes: (1) a direct coordination process (MARLIN-DC), implemented by the agent shown in FIG. 2, in which agents are operable to share their policies and negotiate until converging to a best joint-action; and (2) an indirect coordination process (MARLIN-IC), implemented by the agent shown in FIG. 3, that does not require direct interaction between agents, however agents can build models of each other's control policies to generate decisions.

MARLIN-IC steers the action selection towards actions that represent the best response to the expected neighbours' actions, hence guiding the agent toward coordinated action selection. The best response may be evaluated using models of the neighbours' behaviour that are estimated by the agent from observing the performance of their actions in the past.

MARLIN-DC may use a combination of communication and social conventions between the agent and its neighbours. Communication is used to negotiate the action choices among connected agents. A social convention is used to provide ordering between agents so they can select actions in turn and broadcast their selection to the remaining agents until the best joint control policy is achieved.

Referring to FIG. 1, a system comprises an agent 102 linked to a traffic signal array 104 wherein the agent is operable to optimize control of the traffic signal array by implementing MARLIN-ATC. The agent is operable to optimize control of the traffic signal array based on traffic conditions at both the intersection associated with the linked traffic signal array and one or more other intersections.

The agent 102 may be linked to the traffic signal array 104 by a communication link 106. The agent 102 comprises, or is linked to, one or more learning modules 112 and a mediator module 116. The learning modules and the mediator module may comprise a processor and a memory (not shown). The memory may have stored thereon computer instructions which, when executed by the processor, are operable to provide the functionality described herein. Alternatively, the learning modules and the mediator module may be implemented by a circuit configured to provide the functionality described herein.

In one aspect, the agent may further be linked by a network link 120 to one or more other agents, shown for example as 108, 110, which may be configured similarly to the agent 102.

The agent 102 further comprises, or is linked to, a traffic condition module 118. The traffic condition module 118 is operable to observe local traffic conditions (i.e., at the intersection) in the environment. For example, the traffic condition module 118 may comprise or be linked to vision sensors 122, inductive sensors 124, mechanical sensors 126 and/or other devices 128 to obtain or determine local traffic conditions. The traffic condition module 118 may further comprise a communication unit 130 operable to communicate with smart vehicles to obtain vehicular data (e.g., position, velocity, etc.) from the smart vehicles to determine local traffic conditions.

Each agent may be in communication with one or more other agents to obtain the control policy of the other agents. For example, the mediator module 116 of agent 102 may be in communication with agents 108, 110 to obtain their control policies. Alternatively, the learning module 112 may be in communication with agent 108 and the learning module 114 may be in communication with agent 110 to obtain their control policies.

Alternatively, the agent 102 may model one or more of the other agents 108, 110 to estimate a control policy of the other agent. For example, the learning module may be operable to generate a model for its corresponding other agent. The learning module may then determine (or update the determination of) the joint control policy for its own agent and the other agent. The joint control policy may be a policy that provides a control policy optimized for the two agents acting together, though it does not necessarily follow that such a control policy is an optimized control policy of either of the two agents individually.

Figure 2:
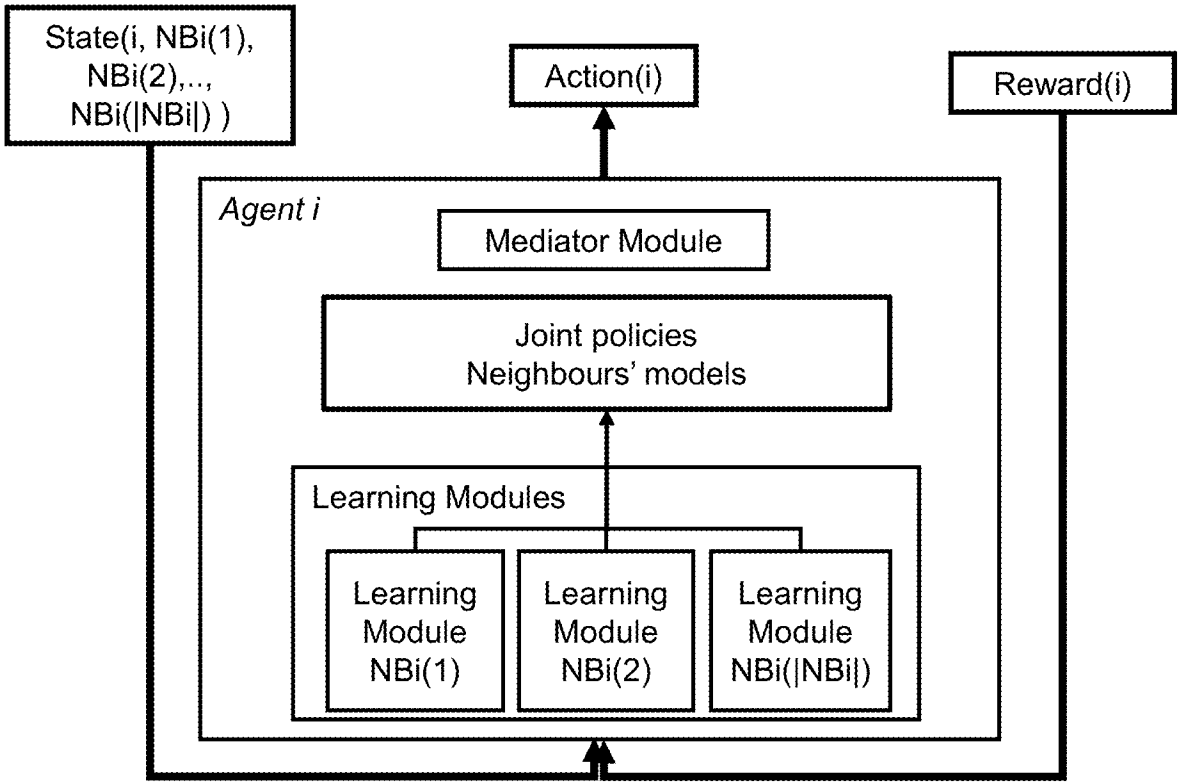
FIG. 2 illustrates an agent implementing an indirect coordination process.

The mediator module 116 of agent 102, as shown in FIG. 2, may implement an indirect coordination process, as follows. The mediator module 116 may obtain the joint control policy of each learning module to generate a control action for the corresponding traffic signal array. The control action may provide optimized traffic flow in the traffic system. The action may be provided to the traffic signal array to control the phase of the traffic signals of the traffic signal array at that time. For example, the control action could be to extend a phase or transition to another phase.

Figure 3:
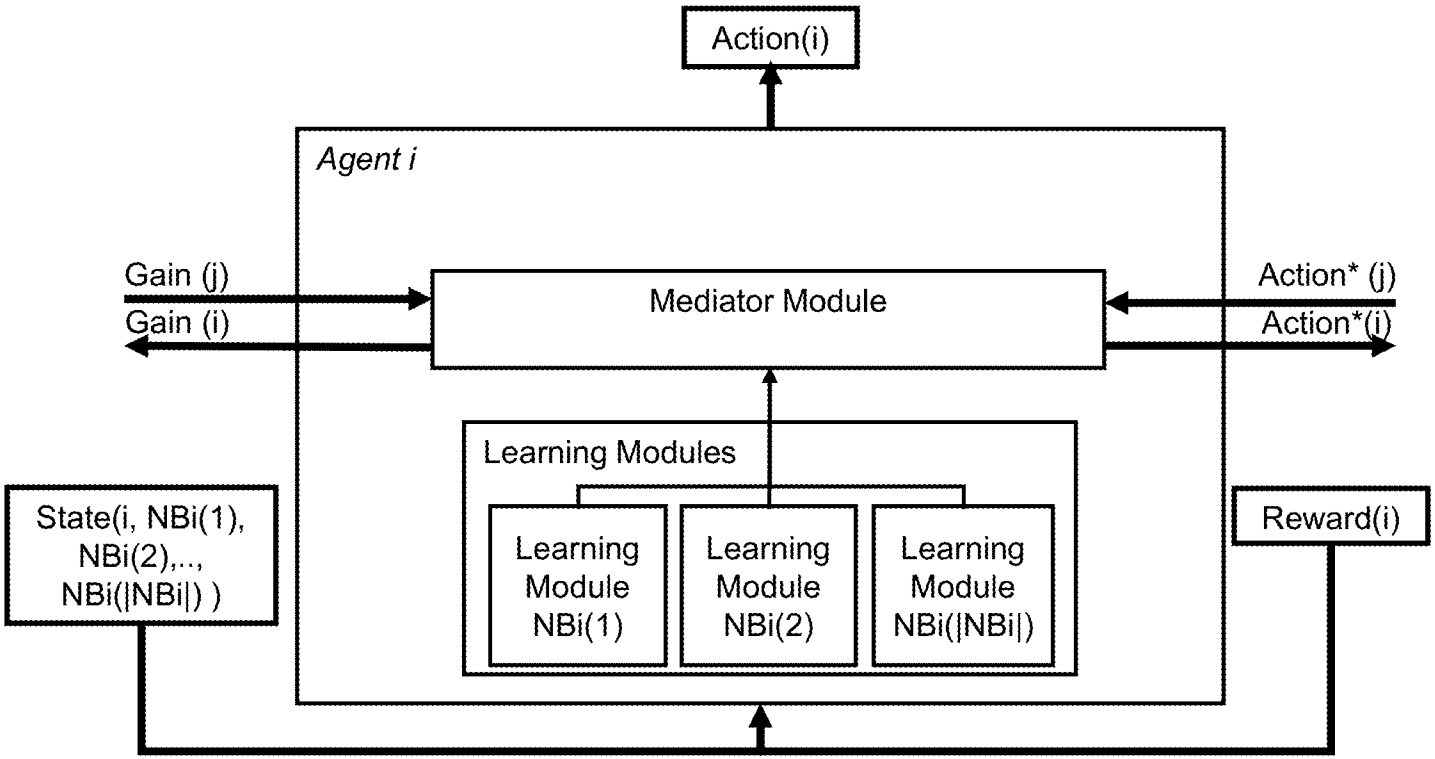
FIG. 3 illustrates an agent implementing a direct coordination process.

The mediator module 116 of agent 102, as shown in FIG. 3, may, alternatively or in addition, implement a direct coordination process, as follows. The mediator module 116 may generate a control action for the corresponding traffic signal array by utilizing: (1) the joint control policy of each learning module; (2) the generated control action provided by the other agents 108, 110 that are in communication with the agent 102; and (3) the maximum gain obtainable from changing the agent's control action to another action provided by the other agents 108, 110 that are in communication with the agent 102.

The generated control action may be provided to the other agents 108, 110 that are in communication with the agent 102. Additionally, the maximum gain obtainable from changing the agent's control action to another action may be provided to the other agents 108, 110 that are in communication with the agent 102. Exchanging the policies and gain messages in the direct coordination process may improve agent i's policy with respect to its neighbours' policies.

In one aspect, a learning module is provided for each of the neighbouring, or adjacent, agents. In additional aspects, a learning module is provided for neighbouring agents comprising a predetermined number of agents, agents located a predetermined distance away from the particular agent, agents in one or more specific linear or non-linear directions from the particular agent, etc. In the following description, a learning module is provided for an example where the neighbouring agents comprise immediately adjacent agents in all directions from the particular agent. It will be appreciated that suitable modifications may provide for alternative implementations.

Figure 4:
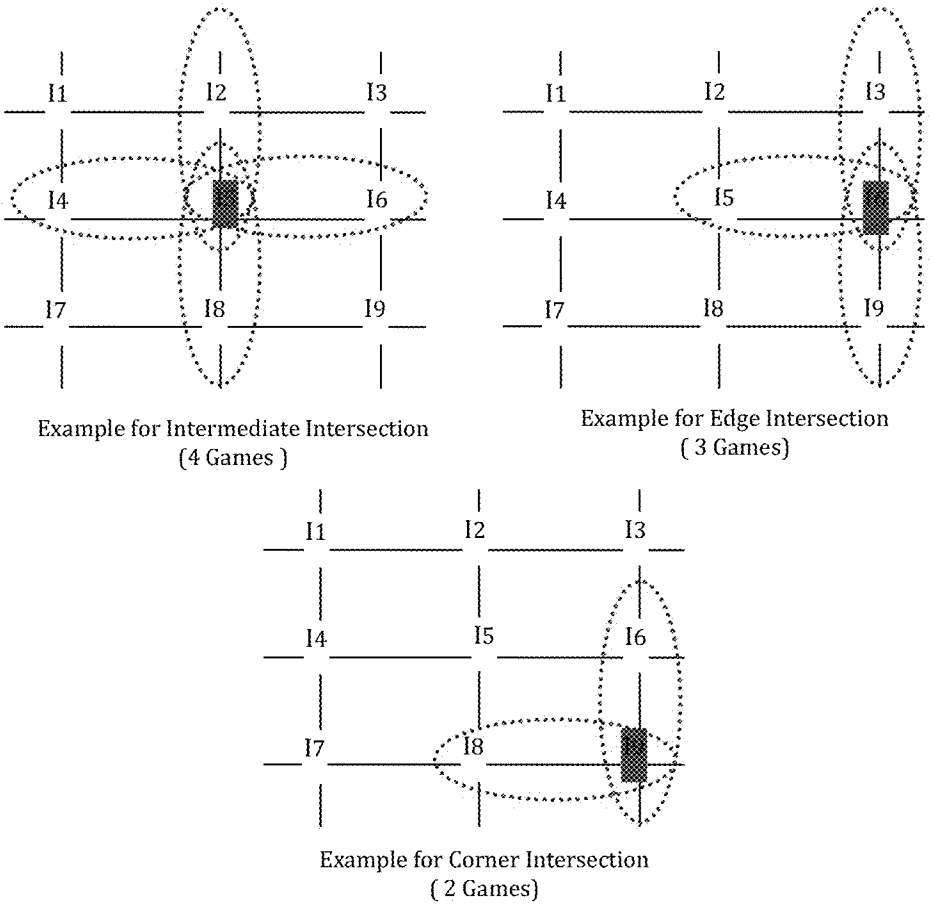
FIG. 4 illustrates an agent among a plurality of intersections in an environment.

Referring now to FIG. 4, MARLIN-ATC implements game theory wherein each agent plays a game with all its adjacent agents at intersections in its neighbourhood. Three cases are shown in FIG. 4 for an illustrative grid network. The three cases shown comprise a first case where an agent at an intermediate intersection of an environment plays a game with four neighbouring agents, a second case where the agent is along an edge intersection of the environment and plays a game with three neighbouring agents, and a third case where the agent is at a corner intersection of the environment and plays a game with two neighbouring agents.

It has been found that an agent implementing MARLIN-ATC may provide optimal traffic signal coordination in a self-learning closed-loop optimal traffic signal control in a stochastic traffic environment. However, MARL traditionally suffers from a dimensionality problem in which the state-space increases exponentially as the number of agents increases. In the embodiments herein, the dimensionality problem may be overcome by dividing the global state space to subsets of joint states, each with the number of other agents with which a particular agent is in communication. For example, each agent may be in communication with only agents at neighbouring intersections, which may be referred to as neighbouring agents. Since each neighbouring agent may be similarly in communication with further neighbouring agents, and so on, a cascading effect may be obtained wherein any given agent implicitly considers all agents in the traffic environment. The embodiments herein reduce computational and economic cost at any given agent while this cascading effect enables each agent to implicitly consider all agents without suffering from the dimensionality problem. Thus, it is possible to control a large urban traffic network through a number of overlapping sets of agents, providing decentralisation which enables robustness and reduces or eliminates system-wide single point of failure in the centralised system.

The learning module may implement game theory to determine its optimal joint control policy. Game theory enables the modelling of multi-agent systems as a multi-player game and provides a rational strategy to each agent in the game. MARL is an extension of reinforcement learning (RL) to multiple agents in a stochastic game (SG) (i.e. multiple players in a stochastic environment). Although prior practical solutions generally limit MARL in SG to optimize a few traffic signal agents (usually just two agents) due to the dimensionality problem, the cascading effect overcomes this limitation.

In MARL-I, RL enables each agent to maximize its cumulative long-run reward. The environment may be modelled as a Markov Decision Process (MDP) assuming that the underlying environment is stationary in which case the environment's state depends only on the agent's actions. One single agent RL method is Q-learning. A Q-Learning agent learns the optimal mapping between the environment's state, s, and the corresponding optimal control action, a, based on accumulating rewards r(s,a). Each state-action pair (s,a) has a value called Q-Factor that represents the expected long-run cumulative reward for the state-action pair (s,a). In each iteration, k, the agent may observe the current state s, choose and execute an action a that belongs to the available set of actions A, and then the Q-Factor may be updated according to the immediate reward r(s,a) and the state transition to state $s^i$ as follows:

$$Q^k(s^k, a^k) = (1-a)Q^{k-1}(s^k, a^k) + a\left[r(s^k, a^k) + \gamma \max_{a^{k+1} \in A} Q^{k-1}(s^{k+1}, a^{k+1})\right]$$

where $\alpha,\gamma \in (0,1]$ may be referred to as the learning rate and discount rate, respectively.

The agent may select the greedy action at each iteration based on the stored Q-Factors, as follows:

$$a^{k+1} \in \operatorname*{argmax}_{a \in A} [Q(s, a)]$$

However, in typical RL methods, the sequence $Q^k$ converges to the optimal value only if the agent visits the state-action pair an infinite number of iterations. Thus, the agent must sometimes explore (try random actions) rather than exploit the best known actions. To balance the exploration and exploitation in Q-Learning, methods such as $\epsilon$-greedy and softmax may be used.

MARLIN-ATC integrated mode may be implemented by an extension of RL to a multiple agents setting and a Markov game (also referred to as a stochastic game) as an extension of MDP to a multiple agents setting. Each agent may implement MARLIN-ATC by playing a plurality of Markov games, one with each neighbouring agent (or the model of each neighbouring agent). The game may be played in a sequence of stages. At each stage, the game has a certain state in which the agents select actions and each agent receives a reward that depends on the current state and the joint action selected by the agents. The game then moves to a new random state whose distribution depends on the previous state and the joint action selected by the agents. This process may be repeated for the new state and continue for a finite or infinite number of iterations.

Thus, at least three advantages may be provided over typical RL methods: (1) maintaining coordination between agents without compromising dimensionality; (2) not limiting to synchronization along an arterial only as it can be applied to any two dimensional networks; and (3) responding adaptively to fluctuations in traffic conditions in the network.

Each agent's objective is to find a joint policy (e.g., an equilibrium) in which each individual policy is a best response to the others, such as Nash equilibrium. Any of a plurality of MARL methods may be used to determine an equilibrium. Examples of MARL methods are: Team Q-Learning for agents with common reward (cooperative games), Nash-Q for general sum games, and Mini-Max-Q for competitive games.

In cases where multiple equilibrium policies exist, agents acting simultaneously may generate a non-equilibrium joint policy. In such cases, agents may apply a coordination process to select the optimal decision from the possible joint actions (i.e., agents may coordinate their choices/actions so as to reach a unique equilibrium policy).

One benefit of coordination stems from the fact that the effect of any agent's action on the environment may depend in part on the actions taken by the other agents. Hence, the agents' choices of actions are preferably mutually consistent in order to achieve their intended effect.

Figure 5:
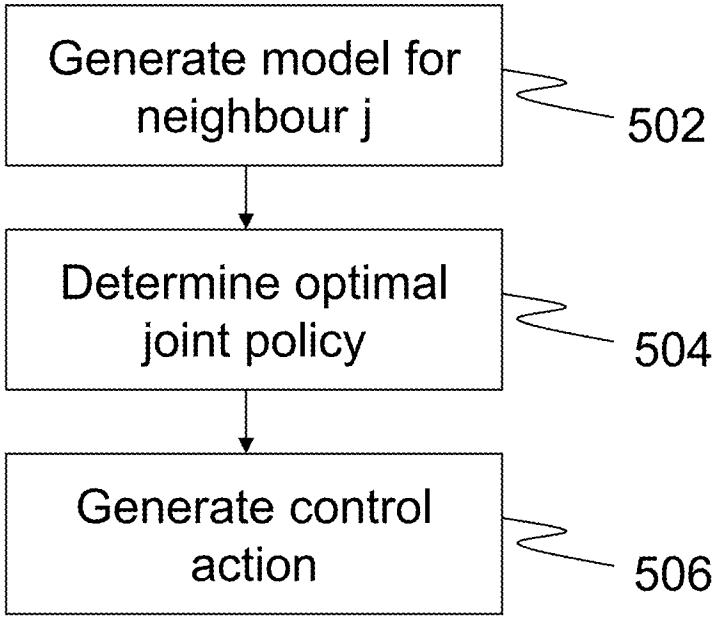
FIG. 5 illustrates a flow diagram of an agent generating a control action.
Figure 6:
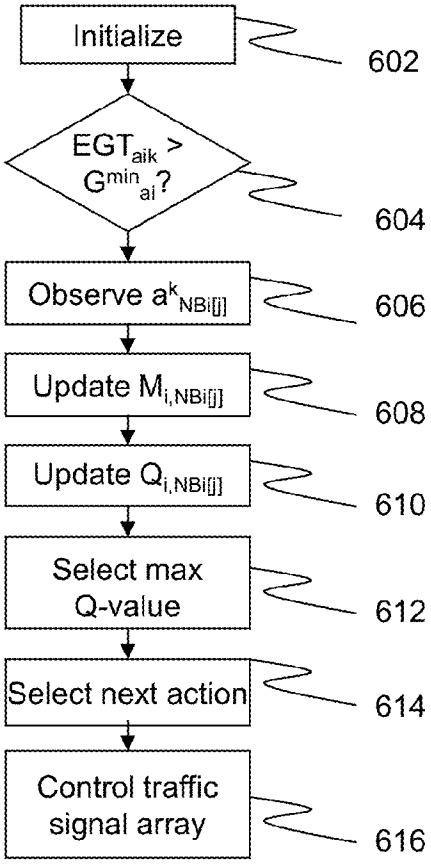
FIG. 6 illustrates a flow diagram of an agent controlling a traffic signal array.

Referring now to FIGS. 5 and 6, an agent is operable to conduct a plurality of games, one with any particular neighbour. Given a network of N agents, each intersection, i, is surrounded by a set of neighbours, $NB_i$. The learning module for each agent i plays a general-sum (each player has different reward function) SG with each neighbour $NB_i[j]$, $j \in \{1, 2, \ldots |NB_i|\}$. The two-player general-sum SG may be represented by the tuple:

$$(N, NB_1, \ldots, NB_N, S_1, \ldots, S_N, JS_1, \ldots, JS_N, A_1, \ldots, A_N, JA_1, \ldots JA_N, R_1, \ldots, R_N)$$

where

N is the number of agents;

$NB_i$ is a set of neighbours surrounding agent i;

$S_i$ is a set of discrete local states for agent i;

$JS_i = S_i \times S_{NB_i[1]} \times \ldots \times S_{NB_i[|NBN_i|]}$ is the joint state space observed by agent i;

$A_i$ is a set of discrete local actions for agent i;

$JA_i = A_i \times A_{NB_i[1]} \times \ldots \times A_{NB_i[|NB_i|]}$ is the joint action space observed by agent i; and $R_i$ is the reward function for agent i $r_i$: $JS_i \times JA_i \rightarrow \mathbb{R}$ For MARLIN-IC, each agent i may generate a control action for its signal as follows. If there are $|NB_i|$ neighbours for agent i with the joint state space $JS_i$ and joint action space $JA_i$, there are $|NB_i|$ partial state and action spaces for agent i. Each partial state space and action space comprises agent i and one of the neighbours $NB_i[j]$, s.t. $j \in NB_i(S_i, S_{NB_i[j]}, A_i, A_{NB_i[j]})$.

At block 502, each agent i may generate a model that estimates the policy for each of its neighbours and is represented by a matrix $M_{i,NB_i[j]}$, s.t. $j \in NB_i$ where the rows are the joint states $S_i \times S_{NB_i[j]}$ and the columns are the neighbour's actions $A_{NB_i[j]}$ (the cells of the matrix may be initialized to zero), as shown at block 602. Each cell $M_{i,NB_i[j]}([s_i, s_{NB_i[j]}], a_{NB_i[j]})$ represents the probability that agent $NB_i[j]$ takes action $a_{NB_i[j]}$ at the joint state $[s_i, s_{NB_i[j]}]$. $M_{i,NB_i[j]}$ may be updated, at block 608, at periodic time steps, k, as follows:

$$M^k_{i,NB_i[j]}([s^k_i, s^k_{NB_i[j]}], a^k_{NB_i[j]}) = \frac{v^k_{NB_i[j]}([s^k_i, s^k_{NB_i[j]}], a^k_{NB_i[j]})}{\sum_{a \in A_{NB_i[j]}} v^k_{NB_i[j]}([s^k_i, s^k_{NB_i[j]}], a)}$$

where $v_{NB_i[j]}([s_i^k, s_{NB_i[j]}^k], \alpha_{NB_i[j]}^k)$ is a function which observes, at block 606, the number of visits agent $NB_i[j]$ visited the state $[s_i^k, s_{NB_i[j]}^k]$ after taking action $a_{NB_i[j]}^k$.

At block 504, each agent i may learn the optimal joint policy for agents i and $NB_i[j] \forall j \in \{1, \ldots, |NB_i|\}$ by updating the Q-values that are represented by a matrix of $|S_i \times S_{NB_i[j]}|$ rows and $|A_i \times A_{NB_i[j]}|$ columns where each cell $Q_{i,NB_i[j]}([s_i, s_{NB_i[j]}], [\alpha_i, \alpha_{NB_i[j]}])$ represents the Q-value for a state-action pair in the partial spaces corresponding to the pair of connected agents (i, $NB_{i\ [j]}$).

At blocks 506 and 610, each agent i may update Q-values $Q_{i,NB_i[j]}([s_i, s_{NB_i[j]}], [\alpha_i, \alpha_{NB_i[j]}])$ using the value of the best-response action taken in the next state, shown at block 612. The best-response value ($br_i$) may be the maximum expected Q-value at the next state, which is calculated using models for other agents. Each Q-value is updated by first choosing the maximum expected Q-value at state $[s_i^{k+1}, s_{NB_i[j]}^{k+1}]$ as follows:

$$br_i^k = \max_{a \in A_i}\left[\sum_{a' \in A_{NB_i[j]}} Q^k_{i,NB_i[j]}([s_i^{k+1}, s^{k+1}_{NB_i[j]}], [a, a'] \cdot M^k_{i,NB_i[j]}([s_i^{k+1}, s^{k+1}_{NB_i[j]}], a')\right]$$

and then updating the Q-value as follows:

$$Q^k_{i,NB_i[j]}([s_i^k, s^k_{NB_i[j]}], [a_i^k, a^k_{NB_i[j]}]) = (1-\alpha^k)Q^{k-1}_{i,NB_i[j]}([s_i^k, s^k_{NB_i[j]}], [a_i^k, a^k_{NB_i[j]}]) + \alpha[r_i^k + \gamma br_i^k]$$

where $$\alpha^k = \frac{\alpha_o}{v_i^k([s_i^k, s^k_{NB_i[j]}], a_i^k)}$$

$$v_i^k([s_i^k, s^k_{NB_i[j]}], a_i^k) = v_i^{k-1} v_i^k([s_i^k, s^k_{NB_i[j]}], a_i^k) + 1$$

where $\alpha$ is the learning rate and $\alpha_0$ is a constant.

The action is selected at block 614 and the signal is controlled in accordance with the action at block 616.

Optionally, the control action of agent i is partially determined by compliance with action rules. For example, an action rule may comprise a minimum green time of a signal such that the above steps may be performed following the elapsing of the minimum green time, as shown at block 604.

In MARLIN-IC the agent may decide its action without direct interaction with the neighbours. Instead, the agent may use the estimated models for the other agents and acts accordingly. Agent i chooses the next action using a simple heuristic decision procedure, which biases the action selection toward actions that have the maximum expected Q-value over its neighbours $NB_i$. The likelihood of Q-values is evaluated using the models of the other agents estimated in the learning process. If agent i exploits, then $$a_i^{k+1} = \underset{a \in A_i}{\operatorname{argmax}}\left[\sum_{j \in \{1,2,\ldots,|NB_i|\}} \sum_{a' \in A_{NB_i[j]}} Q^k_{i,NB_i[j]}([s_i^{k+1}, s^{k+1}_{NB_i[j]}], [a, a']) \cdot M^k_{i,NB_i[j]}([s_i^{k+1}, s^{k+1}_{NB_i[j]}], a')\right]$$

Otherwise, agent i explores, such that $\alpha_i^{k+1}$=random action a$\epsilon$ $A_i$.

Figure 7:
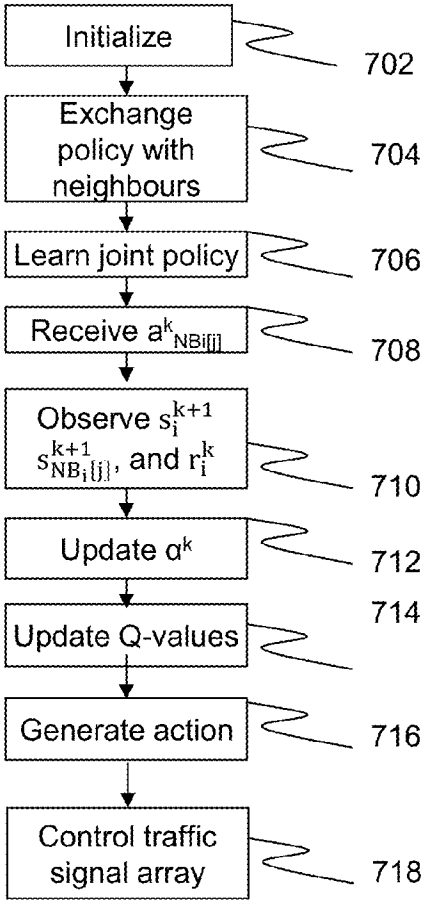
FIG. 7 illustrates another flow diagram of an agent controlling a traffic signal array.

Referring now to FIG. 7, in MARLIN-DC, the learning process may be as follows. If there are $|NB_i|$ neighbours for agent i with the joint state space $JS_i$ and joint action space $JA_i$, there are $|NB_i|$ partial state and action spaces for agent i. Each partial state space and action space may comprise agent i and one of the neighbours $NB_i[j]$, s.t. j $\epsilon$ $NB_i$ ($S_i$,$S_{NB_i[j]}$, $A_i$, $A_{NB_i[j]}$). At block 702, each agent i initializes with a random local policy ($a_i^{*0}$) and, at block 704, exchanges this policy with its neighbours NBi.

At block 706, each agent learns the optimal joint policy with the neighbour $NB_i[j]\forall V$ j $\epsilon\{1, \ldots, |NB_i|\}$ by updating the Q-values that are represented by a matrix of $|S_i \times S_{NB_i}[j]|$ rows and $|A_i \times A_{NB_i[j]}|$ columns where each cell $Q_{i,NB_i[j]}([s_i, s_{NB_i[j]}],[\alpha_i, \alpha_{NB_i[j]}])$ represents the Q-value for a state-action pair in the partial spaces corresponding to the pair of connected agents (i, $NB_i[j]$).

At block 708, each agent i receives $a^*_{NB_i[j]}{}^{*k}$ from its neighbours and, at block 710, observes $s_i^{k+1}$ $s_{NB_i[j]}^{k+1}$, and $r_i^k$. At block 712, the agent updates $\alpha^k$ using the formulae:

$$v_i^k([s_i^k, s^k_{NB_i[j]}], a_i^k) = v_i^{k-1}([s_i^k, s^k_{NB_i[j]}], a_i^k) + 1$$

$$\alpha^k = \frac{\alpha_o}{v_i^k([s_i^k, s^k_{NB_i[j]}], a_i^k)}$$

At block 714, the agent then updates Q-values $Q_{i,NB_i[j]}$ ($[s_i,s_{NB_i[j]}],[\alpha_i, \alpha_{NB_i[j]}]$) using the value of the action that should be taken in the next state following the current policy and given the policy of the neighbouring agents.

$$Q^k_{i,NB_i[j]}([s_i^k, s^k_{NB_i[j]}], [a_i^k, a^k_{NB_i[j]}]) = (1-\alpha^k)Q^{k-1}_{i,NB_i[j]}([s_i^k, s^k_{NB_i[j]}], [a_i^k, a^k_{NB_i[j]}]) + \alpha\left[r_i^k + \gamma \sum_{j \in \{1,2,\ldots,|NB_i|\}} Q^k_{i,NB_i[j]}([s_i^{k+1}, s^{k+1}_{NB_i[j]}], [a_i^{*k}, a^{*k}_{NB_i[j]}]\right]$$

In the indirect coordination process, the mediator module for agent i may generate the next control action for the traffic signal array. In direct coordination, the agent generates the next action by, at block 716, negotiating, with the mediator module, and directly interacting with its neighbours. Then the agent calculates its utility ($U_c$) with respect to its current policy and its neighbours' policies. The agent also calculates the utility of its best-response policy ($U_{br}$) given the policies of its neighbours. The difference between the two utilities ($U_{br}$–$U_c$) represents a gain message.

$$U_{br} = \max_{a \in A_i} \sum_{j \in \{1,2,\ldots,|NB_i|\}} Q^k_{i,NB_i[j]}([s_i^{k+1}, s^{k+1}_{NB_i[j]}], [a, a^{*k}_{NB_i(j)}])$$

$$U_c = \sum_{j \in \{1,2,\ldots,|NB_i|\}} Q^k_{i,NB_i[j]}([s_i^{k+1}, s^{k+1}_{NB_i[j]}], [a_i^{*k}, a^{*k}_{NB_i(j)}])$$

$$\text{Gain}(i) = [U_{br} - U_c]$$

The agent broadcasts its gain message to its neighbours and receives their gain messages. The agent then improves its policy if its gain message is higher than all the gain messages received from its neighbours (i.e. if the subject agent is the winner). If the agent is the winner in the current cycle of the algorithm, it changes its policy to the best policy and broadcasts it to the neighbours.

$$a_i^{k+1} = a_i^{*k+1} = \underset{a \in A_i}{\operatorname{argmax}} \sum_{j \in \{1,2,\ldots,|NB_i|\}} Q^k_{i,NB_i[j]}([s_i^{k+1}, s^{k+1}_{NB_i[j]}], [a, a^{*k}_{NB_i(j)}])$$

This process may be repeated until all connected agents change their policies.

The agent can then provide the control action to the traffic signal array 718 to direct traffic at the intersection. In one aspect, the action may further be provided to other agents with which the agent is in communication.

The agent may be trained prior to field implementation using simulated (historical) traffic patterns. After convergence to the optimal policy, the agent can either be deployed in the field by mapping the measured state of the system to optimal control actions directly using the learnt policy or it can continue learning in the field by starting from the learnt policy. In both cases, no model of the traffic system is required.

Alternatively, the agent may be deployed in the field and learn during field use.

It has been found that particularly effective state definition, action definition, reward definition, and action selection method may be as follows.

The agent's state may be represented by a vector of 2+P components, where P is the number of phases. The first two components may be: (1) index of the current green phase, and (2) elapsed time of the current phase. The remaining P components may be the maximum queue lengths associated with each phase (see equation 5).

$$s^k[j] = \begin{cases} a^k & j = 0 \\ EGT_{a^k} & j = 1 \\ \max_{l \in L_i} q_l^k & \forall\, j \in \{2, 3, \ldots, P+2\} \end{cases} \tag{8}$$

where $q_1^k$ is the number of queued vehicles in traffic lane 1 at time k, which may be obtained by the traffic condition module. The traffic condition module may obtain the maximum queue over all lanes that belong to the lane-group corresponding to phase j, Lj. For example, vehicle (v) may be considered at a queue if its speed is below a certain speed threshold, ($Sp^{Thr}$). For example ($Sp^{Thr}$) may be 7 kilometers per hour. Thus, $q_1^k$ may be obtained as follows:

$$q_1^k = q_1^{k-1} + \sum_{v \in V_1^k} q_v^k \tag{9}$$

$$q_v^k = \begin{cases} 1 \text{ if } Sp_v^{k-1} > Sp^{Thr} \text{ and } Sp_v^k \le Sp^{Thr} \\ -1 \text{ if } Sp_v^{k-1} \le Sp^{Thr} \text{ and } Sp_v^k > Sp^{Thr} \\ 0 \text{ if } Sp_v^{k-1} \le Sp^{Thr} \text{ and } Sp_v^k \le Sp^{Thr} \end{cases}$$

where $V_l^k$ is the set of vehicles travelling on lane 1 at time k.

The mediator module may generate a variable phasing sequence for the traffic signals of the traffic signal array. The mediator module may account for variable phasing sequence in which the control action is no longer an extension or a termination of the current phase as in the fixed phasing sequence approach; instead, it may extend the current phase or switch to any other phase according to the fluctuations in traffic, possibly skipping unnecessary phases. Therefore, the agent may provide an acyclic timing scheme with variable phasing sequence in which not only the cycle length is variable but also the phasing sequence is not predetermined. Hence, the action is the phase that should be in effect next.

$$a^k = j, j \in \{1, 2, \ldots, P\} \tag{10}$$

If the action is the same as the current green phase, then the green time for that phase may be extended by a specific time interval, for example one second. Otherwise, the green light may be switched to phase a after accounting for the yellow (Y), all red (R), and the minimum green ($G^{min}$) times.

$$\Delta^k = \begin{cases} G_{a^k}^{min} + Y^{a^k} + R^{a^k} & \text{if } a^k \ne a^{k-1} \\ 1 \text{ sec} & \text{if } a^k = a^{k-1} \end{cases} \tag{11}$$

For example, $G^{min}$ may be 20 seconds, yellow may be 3 seconds and all red may be 1 second.

Since the goal of each agent is to minimize the total delay experienced in the intersection area associated with that agent, the reward function may be defined as the reduction in the total cumulative delay and this value may differ between agents. Given the vehicle cumulative delay $CD^v$ $Cd_v^k$ which may be defined as the total time spent by vehicle v in a queue (defined by a certain speed threshold $Sp^{Thr}$) up to time step k, the cumulative delay for phase j may be the summation of the cumulative delay of all the vehicles that are currently travelling on lane-group Li. A vehicle may be considered to leave the intersection once it clears the stop line.

$$Cd_v^k = \begin{cases} Cd_v^{k-1} + \Delta^{k-1} & \text{if } Sp_v^k \le Sp^{Thr} \\ Cd_v^{k-1} & \text{if } Sp_v^k > Sp^{Thr} \end{cases} \tag{12}$$

where $\Delta^{k-1}$ is the duration of the previous time step before the decision point at time k, and $Sp_v^k$ is vehicle's speed at time k.

The immediate reward for a particular agent may be defined as the reduction (saving) in the total cumulative delay associated with that agent, i.e., the difference between the total cumulative delays of two successive decision points. The total cumulative delay at time k may be the summation of the cumulative delay, up to time k, of all the vehicles that are currently in the intersections' upstreams. If the reward has a positive value, this means that the delay may be reduced by this value after executing the selected action. However, a negative reward value indicates that the action results in an increase in the total cumulative delay.

$$r^k = \Sigma_{j \in P} \Sigma_{l \in L_i} (\Sigma_{v \in V_l^k} Cd_v^k - \Sigma_{v \in V_l^{k-1}} Cd_v^{k-1}) \tag{13}$$

It will be appreciated that the foregoing embodiments may be applied to analogous control systems of distributed and, potentially, connected networks of agents to suit a wide range of applications beyond traffic signals. These include freeway control to enhance freeway performance by intelligently controlling on-ramps, speed, and changeable message signs; wireless network control to improve the performance of wireless networks by intelligently assigning users to the network's access points (APs); hydro power generation control to optimize use of available water resources by intelligently controlling the amount of water released from reservoirs and the amount of energy traded; wind energy control to balance the load frequency in interconnected networks of wind turbines and voltage control to provide a desirable voltage profile in a network of voltage controller devices. Other suitable implementations would be clear to a person of skill in the art.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

We claim:

1. A system for adaptive traffic signal control comprising:

an agent comprising:

a processor;

a communication interface for coupling to a traffic signal array at a first intersection and to one or more other agents; and a memory storing computer readable instructions that, when executed by the processor, cause the processor to generate and provide to the traffic signal array a control action for the traffic signal array by continuously updating in real-time a joint control policy for causing the agent to collaborate with the one or more other agents in communication with the agent, the one or more other agents controlling selected neighbouring traffic signal arrays located at other intersections neighbouring the first intersection along two dimensions, the joint control policy comprising a traffic optimization policy simultaneously considering both of the two dimensions, determination of the joint control policy comprising:

tracking the control action at each update of the joint control policy and, updating of a Q-value or a Q-factor of the joint control policy to improve a cumulative reward, the updating of the joint control policy being based on:

the tracked control actions;

respective selected control actions and individual control policies exchanged by the agent with the one or more other agents for negotiation, each individual control policy defining a mapping from a traffic state to a control action for the respective agent; and gain messages exchanged by the agent with the one or more other agents comprising, for the exchanged selected control actions and individual control policies, maximum gain values determined by each agent to be obtainable by the respective agent changing its selected control action to the selected actions of the other agents.

2. The system of claim 1, wherein each other intersection is adjacent to the first intersection.

3. The system of claim 1, wherein the agent adapts the joint control policy to stochastic traffic patterns.

4. The system of claim 1, further comprising:

a traffic condition module, executed on the processor, configured to observe local traffic conditions at the traffic signal array that are used, in conjunction with the joint control policy, by the agent to generate the control action.

5. The system of claim 4, wherein the joint control policy used by the agent to generate the control action considers local traffic conditions at the selected neighbouring traffic signal arrays.

6. The system of claim 4, wherein the updating of the joint control policy is based on a state vector for the agent comprising an index of a current green phase of the traffic signal array, elapsed time of a current phase and maximum queue lengths determined based on the observed traffic conditions.

7. The system of claim 4, wherein the cumulative reward is defined as any reduction in total cumulative delay at the traffic signal array based on the observed traffic conditions, and wherein determination of the cumulative reward differs between agents.

8. The system of claim 1, wherein the agent determines the joint control policy via the application of game theory.

9. The system of claim 1, wherein the agent continuously updates in real-time the joint control policy with two or more other selected neighbouring traffic signal arrays located at the other intersections.

10. A method for adaptive traffic signal control comprising:

storing computer-readable instructions in a memory of an agent;

executing the computer-readable instructions with a processor of the agent, causing the agent to:

generate a control action for a traffic signal array at a first intersection with which the agent is in communication by continuously updating in real-time a joint control policy with one or more other agents in communication with the agent, the one or more other agents controlling selected neighbouring traffic signal arrays located at other intersections neighbouring the first intersection along two dimensions, the joint control policy for causing the agent to collaborate with the one or more other agents, the joint control policy comprising a traffic optimization policy simultaneously considering both of the two dimensions, determination of the joint control policy comprising:

tracking the control action at each update of the joint control policy, updating of a Q-value or a Q-factor of the joint control policy to improve a cumulative reward, the updating of the joint control policy being based on:

the tracked control actions;

respective selected control actions and individual control policies exchanged by the agent with the one or more other agents for negotiation, each individual control policy defining a mapping from a traffic state to a control action for the respective agent; and gain messages exchanged by the agent with the one or more other agents comprising, for the exchanged selected control actions and individual control policies, maximum gain values determined by each agent to be obtainable by the respective agent changing its selected control action to the selected actions of the other agents; and providing the control action to the traffic signal array via a communication interface of the agent.

11. The method of claim 10, wherein each other intersection is adjacent to the first intersection.

12. The method of claim 10, further comprising adapting the joint control policy to stochastic traffic patterns.

13. The method of claim 10, further comprising:

observing, by a traffic condition module of the agent, the traffic condition module executed on the processor, local traffic conditions at the traffic signal array that are used, in conjunction with the joint control policy, by the agent to generate the control action.

14. The method of claim 13, wherein the joint control policy used by the agent to generate the control action considers local traffic conditions at the selected neighbouring traffic signal arrays.

15. The method of claim 13, wherein the updating of the joint control policy is based on a state vector for the agent comprising an index of a current green phase of the traffic signal array, elapsed time of a current phase and maximum queue lengths determined based on the observed traffic conditions.

16. The method of claim 13, wherein the cumulative reward is defined as any reduction in total cumulative delay at the traffic signal array based on the observed traffic conditions, and wherein determination of the cumulative reward differs between agents.

17. The method of claim 10, wherein the agent determines the joint control policy via the application of game theory.

18. The method of claim 10, wherein the agent continuously updates in real-time the joint control policy with two or more selected neighbouring traffic signal arrays located at the other intersections.

* * * * *